US006468135B1

(12) United States Patent
Cruz et al.

(10) Patent No.: US 6,468,135 B1
(45) Date of Patent: Oct. 22, 2002

(54) METHOD AND APPARATUS FOR MULTIPHASE CHEMICAL MECHANICAL POLISHING

(75) Inventors: Jose L. Cruz, Essex Junciton; Cuc K. Huynh, Jericho; David L. Walker, Enosburg Falls, all of VT (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/302,639

(22) Filed: Apr. 30, 1999

(51) Int. Cl.[7] ..... B24B 1/00
(52) U.S. Cl. ..... 451/41; 451/287
(58) Field of Search ..... 451/56, 41, 57, 451/285, 288, 289, 443, 444

(56) References Cited

U.S. PATENT DOCUMENTS

| | | | | |
|---|---|---|---|---|
| 5,166,093 | A | | 11/1992 | Grief |
| 5,246,884 | A | | 9/1993 | Jaso et al. |
| 5,302,551 | A | | 4/1994 | Iranmanesh et al. |
| 5,391,258 | A | | 2/1995 | Brancalconi et al. |
| 5,476,606 | A | | 12/1995 | Brancaleoni et al. |
| 5,531,861 | A | | 7/1996 | Yu et al. |
| 5,533,923 | A | | 7/1996 | Shamouilian et al. |
| 5,578,523 | A | | 11/1996 | Fiordalice et al. |
| 5,597,443 | A | | 1/1997 | Hempel |
| 5,637,185 | A | | 6/1997 | Murarka et al. |
| 5,643,406 | A | | 7/1997 | Shimomura et al. |
| 5,645,682 | A | * | 7/1997 | Skrovan ..... 451/56 |
| 5,645,736 | A | | 7/1997 | Allman |
| 5,663,797 | A | | 9/1997 | Sandhu |
| 5,664,990 | A | | 9/1997 | Adams |
| 5,679,169 | A | | 10/1997 | Gonzales et al. |
| 5,704,987 | A | | 1/1998 | Huynh et al. |
| 5,705,435 | A | | 1/1998 | Chen |
| 5,709,593 | A | | 1/1998 | Guthrie et al. |
| 5,710,460 | A | | 1/1998 | Leidy et al. |
| 5,722,875 | A | | 3/1998 | Iwashita et al. |
| 5,725,414 | A | | 3/1998 | Moinpour et al. |
| 5,725,417 | A | | 3/1998 | Robinson |
| 5,733,171 | A | | 3/1998 | Allen et al. |
| 5,733,176 | A | | 3/1998 | Robinson et al. |
| 5,738,574 | A | | 4/1998 | Tolles et al. |
| 5,743,788 | A | | 4/1998 | Vanell |

* cited by examiner

*Primary Examiner*—Derris H. Banks
(74) *Attorney, Agent, or Firm*—Anthony J. Canale; Richard A. Henkler

(57) ABSTRACT

The present invention is a method and apparatus for CMP processing that reduces scratching of the insulating film and conductor lines of a wafer. More specifically, the method and apparatus introduce an aqueous solution to the polishing pad and wafer during various intervals of the polishing procedure.

16 Claims, 4 Drawing Sheets

METHOD AND APPARATUS FOR MULTIPHASE CHEMICAL MECHANICAL POLISHING

BACKGROUND

1. Technical Field of the Present Invention

The present invention generally relates to Chemical Mechanical Polishing (CMP) of wafers, and more specifically to a multiphase CMP processing of wafers.

2. Background of the Present Invention

In the fabrication of semiconductor devices, metal conductor lines are used to interconnect the many components in device circuits. The metal conductor lines serve to interconnect discrete devices, and thus form integrated circuits. The metal conductor lines are further insulated from the next interconnection level by thin layers of insulating material and holes formed through the insulating layers provide electrical access between successive conductive interconnection layers.

In such wiring (conductor lines) processes, it is desirable that the insulating layers have smooth surface topography, since it is difficult to lithographically image and pattern layers applied to rough surfaces. Rough surface topography also results in 1) poor step coverage by subsequent deposited layers, 2) discontinuity of layers across steps, and 3) void formation between topographic features. Poor step coverage by deposited layers and void formation between topographic features result in degraded process yield and a decrease in the reliability of integrated circuits.

In semiconductor circuit manufacturing, CMP is one process used to produce smooth surface topography on insulating layers which separate conductive interconnection pattern layers. CMP can also be used to remove different layers of material from the surface of a semiconductor substrate. For example, following via hole formation in an insulating material layer, a metallization layer is blanket deposited and then CMP is used to produce planar metal studs. This is sometimes referred to as a etch-back step (i.e. a step of etching away an unnecessary portion of a metallic film such as a W (tungsten) film or an Al (aluminum) film formed on an insulating film having a contact hole, thereby exposing the insulating film).

Unfortunately, the current methods used for the CMP process to remove undesired portions of a metallic film often result in severely scratching the insulating film and conductor lines. This severe scratching can produce metal shorts between the conductor lines; and as a result the wafer must be scrapped. For example, if the metallic film to be removed is Al, then the current CMP methods convert the Al into Al(OH)x or (Al(O)x (also referred to as "black aluminum"). The black aluminum can become embedded in the polishing pad and result in the severe scratching of the insulating film and conductor lines.

It would, therefore, be a distinct advantage to have a method and apparatus that would remove the undesired portions of a metallic film without severely scratching the insulating film or conductor lines. The present invention provides such a method and apparatus.

SUMMARY OF THE PRESENT INVENTION

The present invention is a method and apparatus for CMP processing that reduces scratching of the insulating film and conductor lines of a wafer. More specifically, the method and apparatus introduce a cleaning solution to the polishing pad and wafer during various intervals of the polishing procedure.

BRIEF DESCRIPTION OF THE DRAWINGS

The present invention will be better understood and its numerous objects and advantages will become more apparent to those skilled in the art by reference to the following drawings, injunction with the accompanying specification, in which.

DETAILED DESCRIPTION OF THE PREFERRED EMBODIMENT OF THE PRESENT INVENTION

In order to provide a better understanding of the many benefits of the present invention, a general description of a conventional CMP apparatus and the principals of CMP processing are described below in connection with FIGS. 1 and 2.

Figure 1:
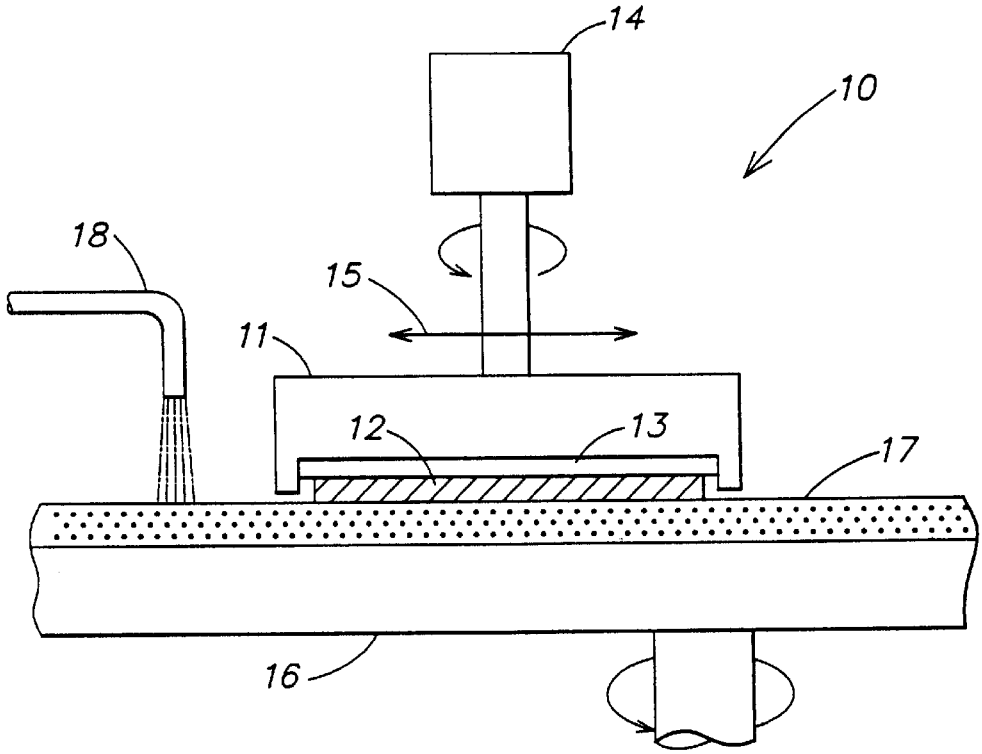
FIG. 1 is a diagram illustrating a conventional rotational Chemical Mechanical Polis apparatus.

FIG. 1 is a diagram illustrating a conventional rotational CMP apparatus (10). The apparatus (10) includes a wafer carrier (11) for holding a semiconductor wafer (12). A soft resilient pad (13) is typically placed between the wafer carrier (11) and the wafer (12); and the wafer (12) is generally held against the resilient pad (13) by a partial vacuum, friction, or adhesive, etc. Frictional affixation can be accomplished by placing a resilient backing pad of uniform thickness between the carrier (11) and the wafer (12), the backing pad having a higher coefficient of friction with respect to the wafer (12) and carrier (11) surface with which it is in contact on opposite sides than the coefficient of friction of the wafer (12) with respect to the slurry saturated polishing pad (17). The wafer carrier (11) is designed for continuous rotation by a drive motor (14). In addition, the wafer carrier (11) is also designed for transverse movement as indicated by the double headed arrow (15). The rotational and transverse movement is intended to reduce variability of material removal rates over the surface of the wafer (12).

The apparatus (10) also includes a rotating platen (16) on which is mounted a polishing pad (17). The platen (16) is relatively large in comparison to the wafer (12), so that during the CMP process, the wafer (12) can be moved across the surface of the polishing pad (17) by the wafer carrier (11). A polishing slurry containing chemically-reactive solution, in which are suspended abrasive particles, is deposited through a supply tube (18) onto the surface of polishing pad (17).

Figure 2:
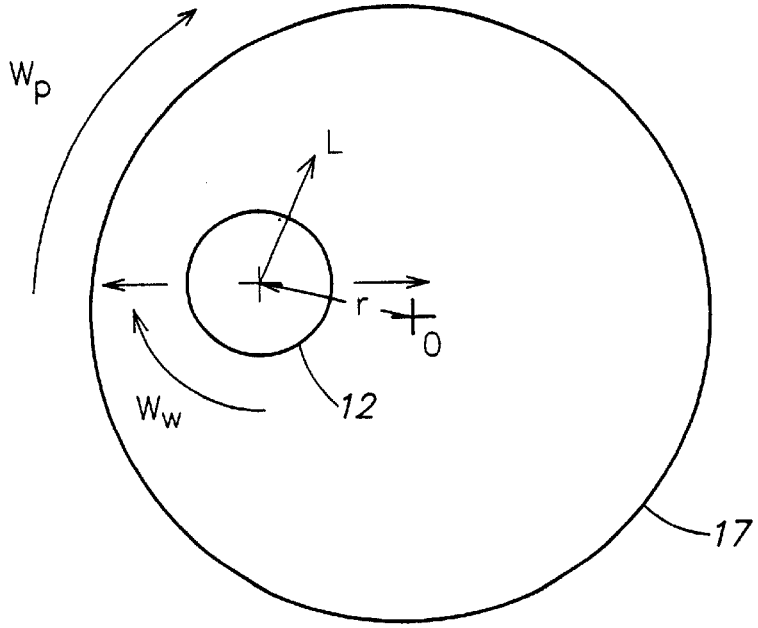
FIG. 2 is a diagram illustrating the principals of the conventional rotational CMP process used he apparatus of FIG. 1.

FIG. 2 is a diagram illustrating the principals of the conventional rotational CMP process used by the apparatus 10 of FIG. 1. The polishing pad (17) is rotated at an angular velocity W radians per second (RADS./sec.) about axis O. The wafer (12) to planarized is rotated at an angular velocity of W Rads./sec., typically in the same rotational sense as the polishing pad (17). It is easily understood that the linear speed (L) of the polishing pad (17) in centimeters/Sec., at any give radius (R) in centimeters form axis O, will be equal to WR. Experience has demonstrated that the rate of removal of material from the wafer surface is related to the speed with which the pad surface makes contact with the wafer surface.

Conventional CMP processes remove undesirable portions of metal film by placing the wafer (12) against the polishing pad (17), dispensing slurry, and maintaining contact between the wafer (12) and polishing pad (17) (as described above) until removal is completed.

Figure 3:
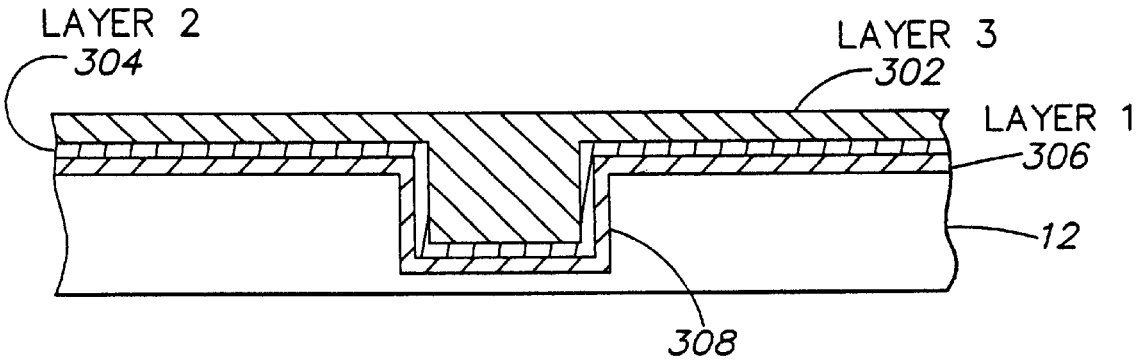
FIG. 3 is a cross-sectional diagram illustrating an example of an unpolished wafer.

FIG. 3 is a cross-sectional diagram illustrating an example of how an unpolished wafer (12) can appear. In this particular example, the wafer (12) includes three layers of metal: a conducting layer 3 (302) Tungsten, Aluminum, or Copper; an adhesive layer 2 (304) Ti-Nitrate($Ti_3N_4$); and an insulating layer 1 (306) Titatium. The formation of a post (plug) (308) will be complete once the undesirable portions of metal layers 3 (302) (Tungsten) and 2 (Ti-Nitrate) (304) are removed.

In this example, a post (308) has been illustrated in order to clearly demonstrate the advantages of the present invention. Those skilled in the art will readily understand and recognize that the present invention is not limited to constructing posts, but is equally applicable to all aspects of removing undesirable metal layers.

As previously described, the conventional CMP process of removing undesirable metal film can result in severe scratching of the insulating film and conductor lines of the wafer. The present invention improves upon the conventional CMP process by introducing several new steps which help reduce the occurrence of severe scratching. Specific detail concerning the improved CMP process is explained in connection with FIG. 4.

Figure 4:
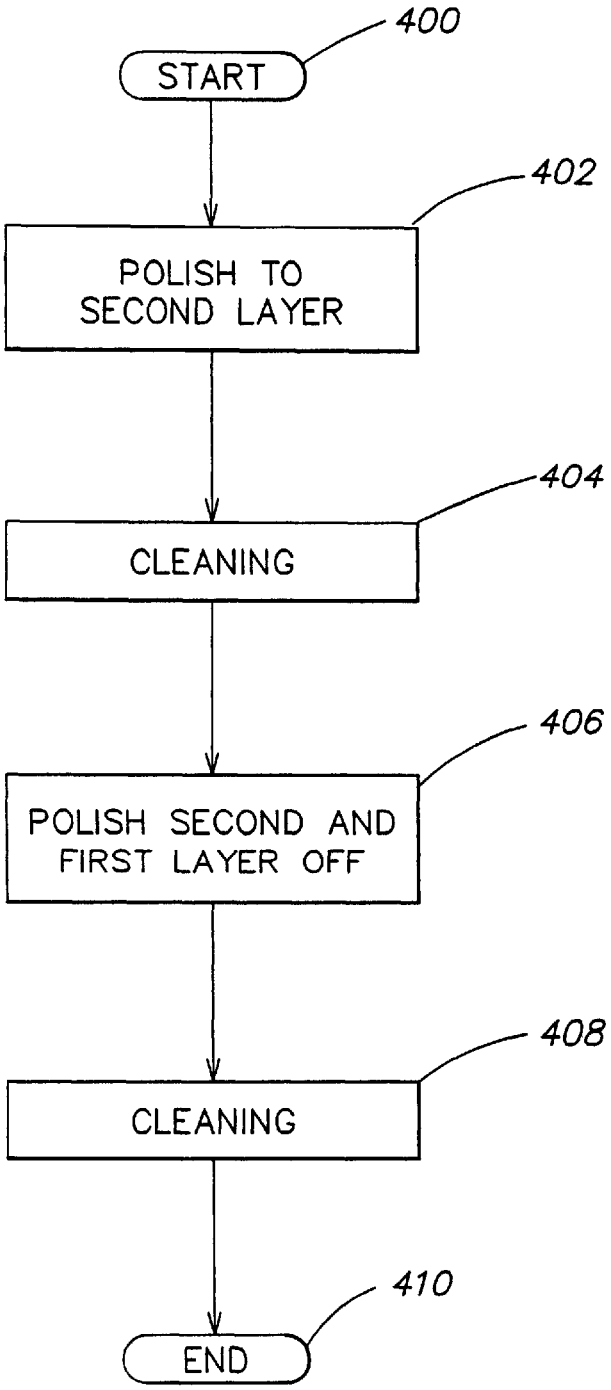
FIG. 4 is a flow chart illustrating the steps for polishing a wafer using the apparatus of FIG. 1 in accordance with the teachings of a preferred embodiment of the present inventions.

FIG. 4 is a flow chart illustrating the steps for polishing a wafer (12) using the apparatus (10) of FIG. 1 in accordance with the teachings of a preferred embodiment of the present invention. The CMP polishing begins with the proper placement of wafer (12) as described above in connection with FIGS. 1–2 (step 400). The polishing proceeds by first oxidizing the Tungsten metal layer (302), and removing any unnecessary portions via an alumina abrasives grinding (step 402).

In the preferred embodiment, this step (402) has been accomplished by dispensing slurry, and rotating the wafer (12) at 50/50 RPM with a down force of 8 Pounds per Square Inch (PSI) until an "End Point" process has indicated that removal of the undesired portions of the Tungsten metal layer (302) has been completed.

The polishing then proceeds to add cleaning solution (e.g. the cleaning solution could be an aqueous alone or with additives which alter the pH level of the solution, such as, acetic acid, oxalic acid, triethanol amine, akonyl amine) onto the polishing pad (17) while the wafer (12) is still in contact with the polishing pad (17) (step 404). This step (404) cleans the polishing pad (17) and wafer (12) of Tungsten debris which was created from the previous step (402). The dispensing of the cleaning solution onto the polishing pad (17) can be accomplished in numerous ways. For example, a tube similar to the slurry dispensing tube (18) could be used.

Figure 6:
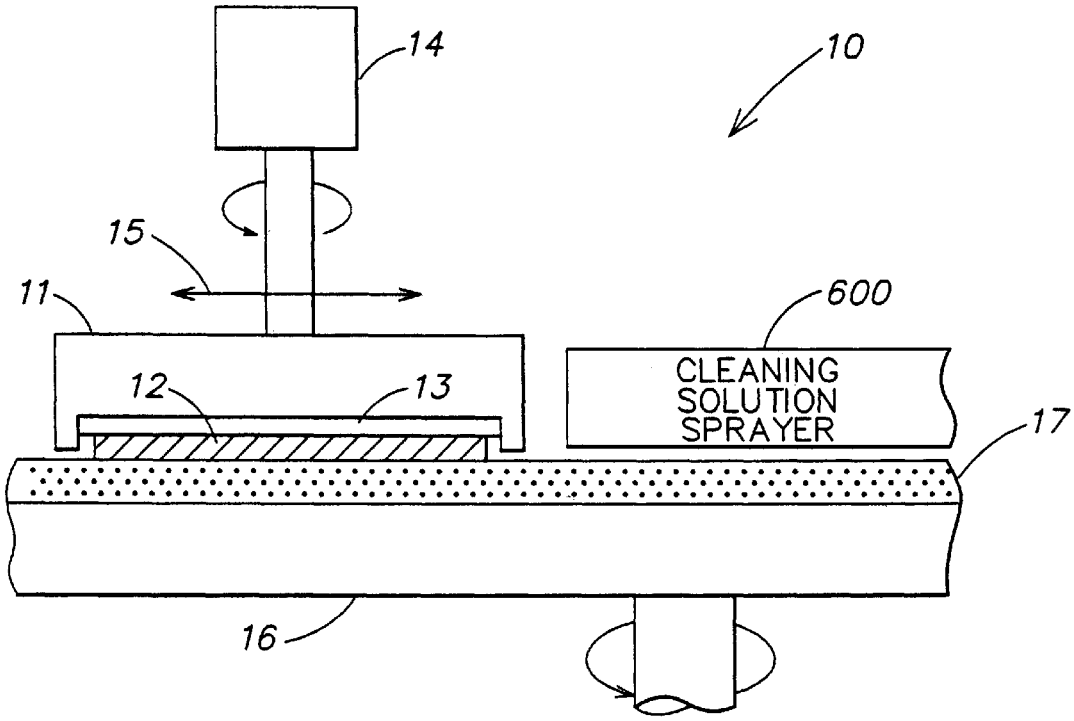
FIG. 6 diagram illustrating the addition of a cleaning solution sprayer to the CMP apparatus of FIG. 1 according to the teachings of the preferred embodiment of the present invention.

In the preferred embodiment of the present invention, the dispensing of the cleaning solution is accomplished by the addition of a cleaning solution sprayer to the CMP apparatus (10) of FIG. 1. FIG. 6 illustrates this addition of the cleaning solution sprayer (600). The cleaning solution sprayer (600) is preferably mounted on a rotatable arm (not shown) that provides the ability to move the cleaning solution sprayer (600) into a position over the polishing pad (17) when cleaning is required, and for its removal when cleaning has been completed. It should be noted that regardless of where the cleaning solution sprayer (600) is ultimately placed, the placement must not interfere with the ability to maintain contact between the wafer (12) and polishing pad (17) during the cleaning process. The cleaning solution sprayer (600) uses spray nozzles to dispense the cleaning solution. The particular design and placement of these spray nozzles are subject to personal preferences, and therefore, numerous.

Figure 7:
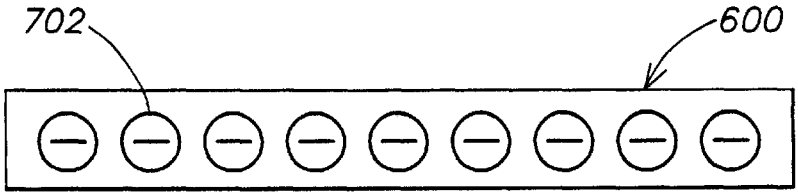
FIG. 7 is a diagram illustrating the design and placement of spray nozzles for the cleaning solution sprayer of FIG. 6 according to the teachings of the preferred embodiment of the present invention.

FIG. 7 represents a preferred embodiment for the design and placement of spray nosels (702) for the cleaning solution sprayer (600) of FIG. 6. As illustrated, the design of a spray nosel (702) is circular with a horizontal release point. A number of spray nosels (702) have been placed in a single vertical line extending the length and width of the cleaning solution sprayer (600).

In the preferred embodiment of the present invention, deionized water is used as the cleaning solution, and step (404) is accomplished by repeating the following for 15 seconds: 1). applying the deionized water via the cleaning solution sprayer (600); and 2). rotating the wafer (12) at 50/50 RPM with a down force of 2 PSI.

The polishing of the wafer (12) then proceeds by removal of the Ti layer 2 (304) (step 406). In the preferred embodiment of the present invention, 70 nm of the Ti layer 2 (304) is removed by applying a down force of 5 PSI with a rotational speed of 75/100 RPM, while slurry is dispensed for 45 seconds.

The polishing of the wafer (12) continues by once again cleaning the polishing pad (17) and wafer (12) of debris while contact between the wafer (12) and polishing pad (17) is maintained (step 408). More specifically, deionized water is once again applied. In the preferred embodiment of the present invention, the following steps are repeated for 16 seconds: 1.) deionized water is sprayed onto the polishing pad (17) via the cleaning solution sprayer (600); 2.) a down force of 2 PSI is applied to the wafer (12); and 3.) the wafer is rotated at 50/50 RPM.

The polishing of the wafer (12) then proceeds to conclude by taking any additional steps as desired to obtain the necessary results for the particular application (step 410).

Figure 5:
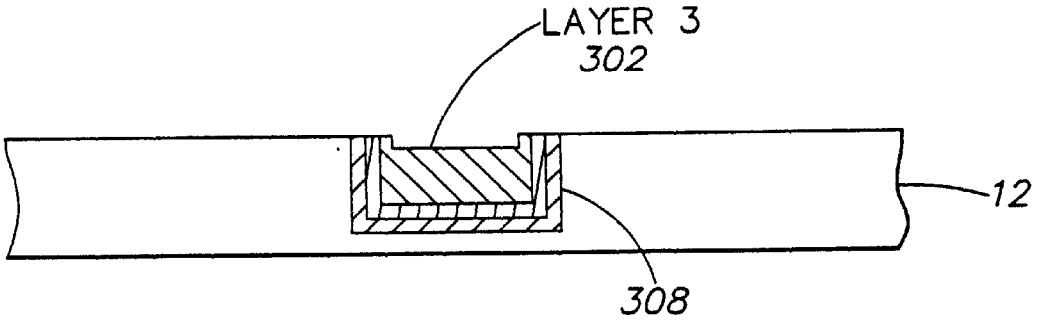
FIG. 5 is a cross-sectional diagram illustrating an example of a wafer that was subjected to the CMP process of FIG. 4 in accordance with the teachings of the present invention.

FIG. 5 is a cross-sectional diagram illustrating an example of how the unprocessed wafer (12) of FIG. 3 might appear after being subjected to the improved CMP process of FIG. 4. As illustrated, only an amount of Tungsten layer 1 (302) sufficient to form the next metal interconnect remains.

It is thus believed that the operation and construction of the present invention will be apparent from the foregoing description. While the method and system shown and described has been characterized as being preferred, it will be readily apparent that various changes and/or modifications could be made therein without departing from the spirit and scope of the present invention as defined in the following claims.

What is claimed is:

1. A method of chemical mechanical polishing of a wafer to remove undesired portions of a deposited electrical conductive film, the method comprising the steps of:

dispensing slurry onto a rotating polishing pad;

pressing the wafer onto the slurry and rotating polishing pad until undesirable portions of the conductive film have been removed; and dispensing, while the wafer is pressed on the rotating polishing pad, cleaning solution to clean the polishing pad and wafer of removed conductive film debris.

2. The method of claim 1 wherein the cleaning solution is an aqueous solution.

3. The method of claim 2 wherein the cleaning solution has a neutral pH.

4. The method of claim 3 wherein the cleaning solution is water.

5. The method of claim 4 wherein the step of dispensing, while the wafer is pressed on the rotating polishing pad, cleaning solution, includes the step of:

spraying, while the wafer is pressed on the rotating polishing pad, water to clean the polishing pad and wafer of removed conductive film debris.

6. The method of claim 1 wherein the step of dispensing, while the wafer is pressed on the rotating polishing pad, cleaning solution to clean the polishing pad and wafer of removed conductive film debris includes the step of:

dispensing, while the wafer is pressed on the rotating polishing pad, cleaning solution to physically dislodge and flush away removed conductive film debris.

7. The method of claim 6 wherein the pad is a non-abrasive pad.

8. A method of chemical mechanical polishing of a wafer having an electrical conductive film and an adhesive film, the method comprising the steps of:

dispensing slurry onto a rotating polishing pad;

pressing the wafer onto the slurry and rotating polishing pad until undesirable portions of the conductive film have been removed; and dispensing, while the wafer is pressed on the rotating polishing pad, cleaning solution to clean the polishing pad and wafer of removed conductive film debris.

9. The method of claim 8 further comprising the steps of:

dispensing slurry onto the rotating polishing pad;

pressing the wafer onto the slurry and rotating polishing pad until undesirable portions of the adhesive film have been removed; and dispensing, while the wafer is pressed on the rotating polishing pad, cleaning solution to clean the polishing pad and wafer of removed adhesive film debris.

10. The method of claim 9 wherein the step of dispensing, while the wafer is pressed on the rotating polishing pad, cleaning solution to clean the polishing pad and wafer of removed conductive film debris, includes the step of:

spraying, while the wafer is pressed on the rotating polishing pad, cleaning solution to clean the polishing pad and wafer of removed conductive film debris.

11. The method of claim 10 wherein the step of dispensing, while the wafer is pressed on the rotating polishing pad, cleaning solution to clean the polishing pad and wafer of removed adhesive film debris, includes the step of:

spraying, while the wafer is pressed on the rotating polishing pad, cleaning solution to clean the polishing pad and wafer of removed adhesive film debris.

12. The method of claim 11 wherein the cleaning solution is an aqueous cleaning solution.

13. The method of claim 12 wherein the cleaning solution has a neutral pH.

14. The method of claim 13 wherein the cleaning solution is water.

15. The method of claim 8 wherein the step of dispensing, while the wafer is pressed on the rotating polishing pad, cleaning solution to clean the polishing and wafer of removed conductive film debris includes the step of:

dispensing, while the wafer is pressed on the rotating polishing pad, cleaning solution to physically dislodge and flush away removed conductive film debris and adhesive film debris.

16. The method of claim 15 wherein the pad is a non-abrasive pad.

* * * * *